US008594517B2

(12) United States Patent
Usui et al.

(10) Patent No.: US 8,594,517 B2
(45) Date of Patent: Nov. 26, 2013

(54) COLOR IMAGE FORMING APPARATUS HAVING FUNCTION OF OBTAINING COLOR INFORMATION OF PATCH

(75) Inventors: Masatake Usui, Susono (JP); Hiroshi Kita, Mishima (JP); Shun-ichi Ebihara, Suntou-gun (JP); Ken Yokoyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 13/023,833

(22) Filed: Feb. 9, 2011

(65) Prior Publication Data

US 2011/0217052 A1 Sep. 8, 2011

(30) Foreign Application Priority Data

Mar. 5, 2010 (JP) ..... 2010-049865

(51) Int. Cl.
*G03G 15/00* (2006.01)

(52) U.S. Cl.
USPC ..... 399/15; 399/49; 399/72; 358/1.9; 358/518

(58) Field of Classification Search
USPC ..... 399/15, 72
See application file for complete search history.

(56) References Cited

U.S. PATENT DOCUMENTS

| | | | | |
|---|---|---|---|---|
| 3,817,103 | A * | 6/1974 | Diamond et al. | 374/104 |
| 5,416,613 | A * | 5/1995 | Rolleston et al. | 358/518 |
| 5,583,644 | A * | 12/1996 | Sasanuma et al. | 358/296 |
| 6,031,629 | A * | 2/2000 | Shibuya et al. | 358/1.9 |
| 6,494,557 | B1 * | 12/2002 | Kato et al. | 347/19 |
| 6,582,050 | B2 * | 6/2003 | Akiyama | 347/19 |
| 6,761,426 | B2 * | 7/2004 | Tsuchiya et al. | 347/19 |
| 6,809,837 | B1 * | 10/2004 | Mestha et al. | 358/1.9 |
| 6,853,815 | B2 | 2/2005 | Tezuka et al. | |
| 6,934,481 | B2 * | 8/2005 | Hama | 399/49 |
| 7,097,270 | B2 * | 8/2006 | Yamazaki | 347/19 |
| 7,269,369 | B2 | 9/2007 | Tezuka et al. | 399/72 |
| 7,587,149 | B2 * | 9/2009 | Suzuki et al. | 399/49 |
| 7,733,547 | B2 * | 6/2010 | Murakami | 358/518 |
| 7,944,595 | B2 * | 5/2011 | Sumi et al. | 358/525 |
| 7,957,657 | B2 * | 6/2011 | Zirilli et al. | 399/49 |
| 8,253,975 | B2 * | 8/2012 | Bai | 358/1.9 |
| 8,390,885 | B2 * | 3/2013 | Liu et al. | 358/1.9 |
| 2003/0085941 | A1 * | 5/2003 | Tezuka et al. | 347/19 |
| 2005/0248789 | A1 * | 11/2005 | Kita et al. | 358/1.9 |
| 2009/0073469 | A1 * | 3/2009 | Kita et al. | 358/1.9 |
| 2009/0251715 | A1 * | 10/2009 | Kita | 358/1.9 |
| 2012/0154832 | A1 * | 6/2012 | Yokoyama et al. | 358/1.9 |
| 2012/0219306 | A1 * | 8/2012 | Shiomichi et al. | 399/15 |
| 2013/0136473 | A1 * | 5/2013 | Kita et al. | 399/49 |

FOREIGN PATENT DOCUMENTS

| | | | |
|---|---|---|---|
| JP | 2003-84532 | | 3/2003 |
| JP | 2005062272 | A * | 3/2005 |

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus uses the difference in time taken for each patch to reach a color sensor, which occurs upon reversing the conveyance direction of a printing material. Due to this difference in time, the temperature of the printing material in detection by the color sensor differs among the respective patches. The error of a colorimetric value due to thermochromism is reduced by placing a patch with a colorimetric value which has a low temperature dependence so as to be detected earlier, and a patch with a colorimetric value which has a high temperature dependence so as to be detected later.

7 Claims, 15 Drawing Sheets

| | ΔE/Δt |
|---|---|
| RED | 0.075 |
| MAGENTA | 0.065 |
| CYAN | 0.058 |
| YELLOW | 0.025 |
| BLUE | 0.023 |
| GREEN | 0.018 |

15a

| TEMPERATURE CHARACTERISTIC LUT | | | | | | | | |
|---|---|---|---|---|---|---|---|---|
| | PATCH DATA | | | | | VARIATION PER UNIT TEMPERATURE | | |
| | C | M | Y | K | | ΔL*' | Δa*' | Δb*' |
| RED | 0 | 1 | 1 | 0 | | −0.034 | −0.039 | −0.049 |
| MAGENTA | 0 | 1 | 0 | 0 | | −0.038 | −0.032 | −0.035 |
| ⋮ | ⋮ | ⋮ | ⋮ | ⋮ | | ⋮ | ⋮ | ⋮ |

COLOR IMAGE FORMING APPARATUS HAVING FUNCTION OF OBTAINING COLOR INFORMATION OF PATCH

BACKGROUND OF THE INVENTION

1. Field of the Invention

The present invention relates to a color image forming apparatus which forms a color image.

2. Description of the Related Art

In recent years, a color image forming apparatus which is typified by, for example, a color printer and a color copying machine and adopts, for example, the electrophotographic or inkjet scheme must output higher-quality images. To meet this requirement, Japanese Patent Laid-Open No. 2003-084532 proposes a color image forming apparatus including a color sensor located downstream of a fixing unit. The color sensor irradiates a patch formed on a printing material with light to obtain its color value (color information) from the light reflected by it. The color image forming apparatus adjusts the tone of a toner image formed on the printing material, in accordance with the output from the color sensor.

Upon colorimetry of the patch formed on the printing material, the colorimetric value of the color information often varies depending on the temperatures of the printing material and toner. Namely, the colorimetric value of the heated patch immediately after fixing is different from that of the patch cooled to room temperature. This variation includes a variation due to the influence of a fluorescent material (for example, a fluorescent bleaching agent contained in the printing material) and that due to the influence of a nonfluorescent material (toner components), is commonly called thermochromism. Due to this thermochromism, the colorimetric value varies depending on the temperatures of the printing material and toner upon colorimetry of the patch output onto the printing material. Also, this variation exhibits different characteristics depending on the color of the patch. This generates an error in the colorimetric value when high-accuracy colorimetry is necessary. To reduce a measurement error due to thermochromism, the printing material heated upon fixing need only be cooled. However, when the apparatus is stopped until the printing material sufficiently cools, it takes a long time to perform one measurement operation. In other words, it is demanded to reduce a measurement error due to thermochromism while suppressing deterioration in usability.

SUMMARY OF THE INVENTION

According to an aspect of the present invention, there is provided an image forming apparatus including a fixing unit configured to heat and fix a toner image transferred onto a printing material. The image forming apparatus includes a switchback mechanism configured to reverse a conveyance direction of a printing material on which the toner image is fixed; and a colorimetry unit which is located in a vicinity of a conveyance path conveying the printing material, the conveyance direction of which is reversed by the switchback mechanism, and is configured to obtain pieces of color information of patches of a plurality of colors, formed on the printing material, from light reflected by the patches of the plurality of colors upon irradiating the patches of the plurality of colors with light. An average of a variation in the color information of a patch, formed in a first region on the printing material, in response to a predetermined change in temperature is larger than an average of a variation in the color information of a patch, formed in a second region on the printing material, in response to the predetermined change in temperature, and the first region and the second region are on a leading edge side and a rear edge side, respectively, at a time of passage through the fixing unit when the printing material is divided into two regions in a direction perpendicular to the conveyance direction.

According to another aspect of the present invention, the image forming apparatus includes a switchback mechanism configured to reverse a conveyance direction of a printing material on which the toner image is fixed; and a colorimetry unit which is located in a vicinity of a conveyance path conveying the printing material, the conveyance direction of which is reversed by the switchback mechanism, and is configured to obtain pieces of color information of patches of a plurality of colors, formed on the printing material, from light reflected by the patches of the plurality of colors upon irradiating the patches of the plurality of colors with light. When a variation in the color information of each patch, formed on the printing material, in response to a predetermined change in temperature is approximated by a linear function in an order of formation of the patches, the linear function has a negative gradient.

Further features of the present invention will become apparent from the following description of exemplary embodiments with reference to the attached drawings.

DESCRIPTION OF THE EMBODIMENTS

Embodiments of the present invention will be described in detail with reference to the accompanying drawings.

First Embodiment

Figure 1:
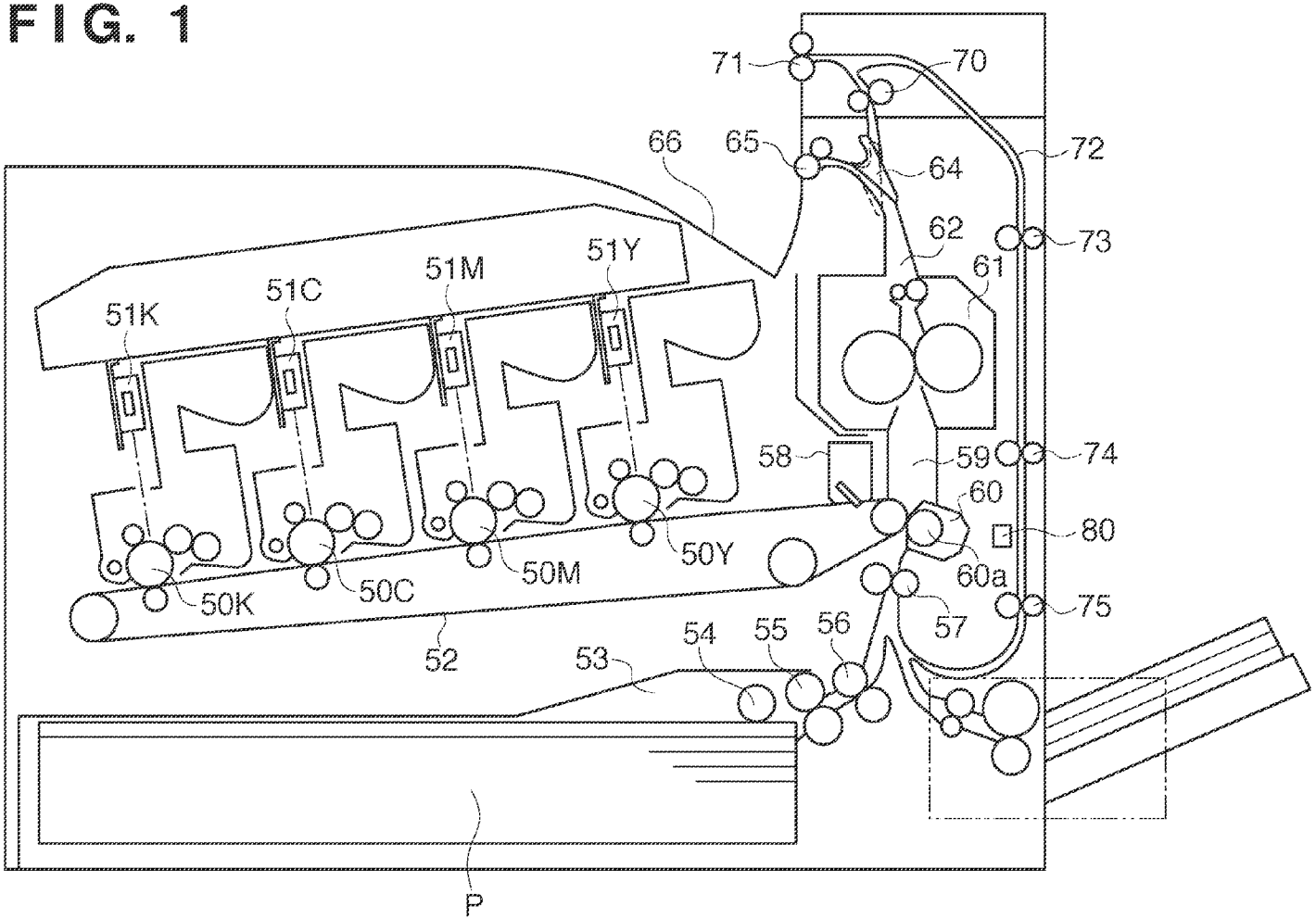
FIG. 1 is a sectional view of an image forming apparatus according to the first embodiment.

An image forming process in an image forming apparatus according to this embodiment will be described first with reference to FIG. 1. Photosensitive drums (photosensitive bodies) 50Y, 50M, 50C, and 50K are provided in image forming stations including toners of yellow Y, magenta M, cyan C, and black K, respectively. Latent images are formed on the surfaces of the photosensitive drums 50Y, 50M, 50C, and 50K by exposing them to laser light beams emitted by laser scanner devices 51Y, 51M, 51C, and 51K, respectively, based on an image signal sent from a controller 12 (to be described later). Further, the latent images on the photosensitive drums 50Y, 50M, 50C, and 50K are developed by toners of yellow, magenta, cyan, and black, respectively, to form toner images on them. The toner images of respective colors, which are formed on the photosensitive drums 50Y, 50M, 50C, and 50K, are primarily transferred by an intermediate transfer belt 52 serving as an image carrier which carries an image. Printing materials P stacked on a sheet feed cassette 53 are fed by a sheet feed roller 54, are conveyed by a feed/retard roller pair 55 and conveyance roller pair 56, and are further conveyed to a registration roller pair 57 that are stopped. After any skew of the printing material P is corrected by the registration roller pair 57, the printing material P is conveyed to a secondary transfer unit 60 at a predetermined timing to transfer the toner image on the intermediate transfer belt 52 onto the printing material P. The printing material P is conveyed to a fixing unit 61 along a conveyance guide 59 serving as a conveyance guide member by a secondary transfer roller 60*a* serving as a transfer member of the secondary transfer unit 60 and the intermediate transfer belt 52, and the toner image is fixed (heated and pressurized). The toner which remains on the intermediate transfer belt 52 without being transferred onto the printing material P by the secondary transfer unit 60 is scraped by a cleaning member 58 and removed from the surface of the intermediate transfer belt 52.

An automatic double-sided print mechanism will be described next. If one designates the formation of an image on only one surface of the printing material P, a flapper 64 is moved to a position indicated by a solid line by a control means and a driving means (neither is shown). Thus, the printing material P having passed through the fixing unit 61 is conveyed to a sheet delivery roller pair 65 and delivered onto a sheet delivery tray 66. On the other hand, if one designates the formation of images on the two surfaces of the printing material P, the flapper 64 is moved to a position indicated by a broken line by the control means and the driving means (neither is shown). After the rear edge of the printing material P passes through a conveyance roller pair 70, a reversing roller pair 71 is rotated in the reverse direction so that the printing material P switches back, thereby reversing the conveyance direction and guiding the printing material P to a conveyance path 72. The printing material P is conveyed to the registration roller pair 57 again using double-sided conveyance roller pairs 73, 74, and 75, has its skew corrected, and is conveyed to the secondary transfer unit 60 at a predetermined timing, thereby transferring the toner image on the intermediate transfer belt 52 onto the lower surface of the printing material P. The printing material P is conveyed to the fixing unit 61 along the conveyance guide 59 by the secondary transfer roller 60*a* of the secondary transfer unit 60 and the intermediate transfer belt 52, and the toner image is fixed on the lower surface of the printing material P. The printing material P is delivered onto the sheet delivery tray 66, thus completing double-sided printing.

Figure 2A:
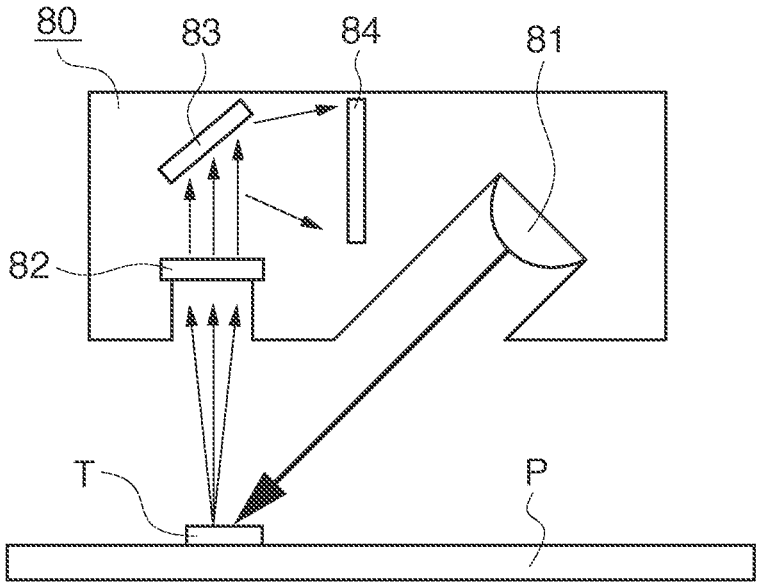
FIG. 2A is a view for explaining a color sensor.
Figure 2B:
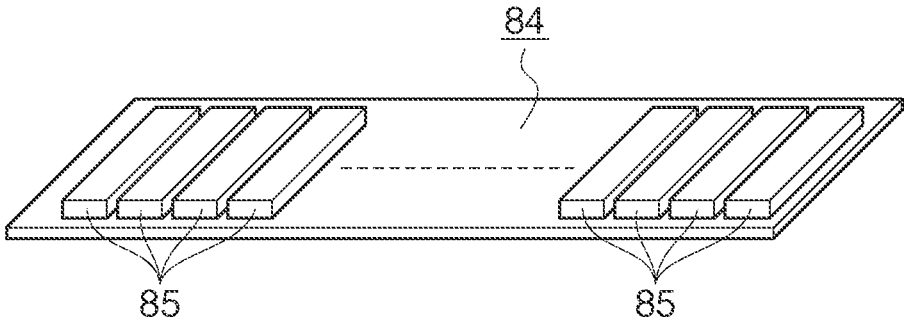
FIG. 2B is a view for explaining a charge-storage sensor.

The image forming apparatus includes a color sensor 80 which obtains a plurality of pieces of color information. As shown in FIG. 1, the color sensor 80 is located in the vicinity of the conveyance path 72 conveying the printing material P, a conveyance direction of which has been reversed by a switchback mechanism, and obtains the color value of a toner patch T fixed on the printing material P having switched back. Note that the vicinity of the conveyance path, which serves as the setting position of the color sensor 80, means a position spaced apart from the conveyance path by the distance at which the color sensor 80 can detect the color of the patch on the conveyed printing material. As shown in FIG. 2A, the color sensor 80 obliquely guides light output from a white LED 81 onto the printing material P, on which the patch T is printed, from the 45° direction. Light diffusely reflected by the patch T is converted into collimated light by a collimator lens 82, undergoes wavelength dispersion by an action of a diffraction grating 83, and enters a charge-storage sensor 84. As shown in FIG. 2B, a light-receiving unit 85 of the charge-storage sensor 84 includes independent, linearly juxtaposed light-receiving elements, and measures the light reception intensity for each wavelength range. The wavelength resolution of the color sensor 80 can be adjusted by appropriately setting the characteristics of the diffraction grating 83 and the density at which light-receiving elements are juxtaposed. The color sensor 80 according to this embodiment measures the intensity of light with wavelengths of 380 nm to 780 nm for each 10 nm to measure its spectral reflectivity. By measuring the spectral reflectivity for each wavelength, a color difference $\Delta E$ can be calculated from a variation in profile of the spectral reflectivity. The profile of the spectral reflectivity means herein the distribution of the spectral reflectivity determined by the color and temperature.

Figure 3:
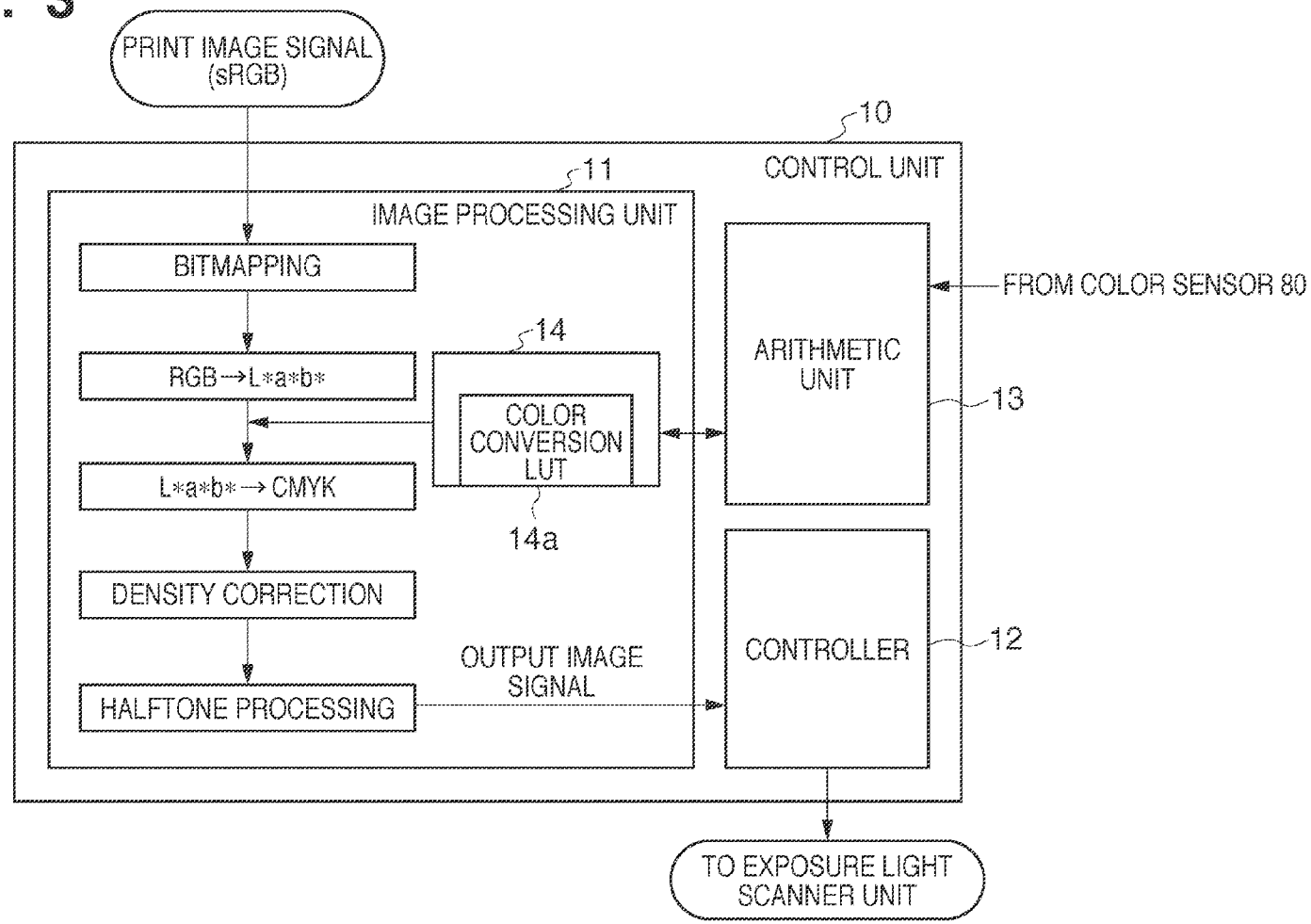
FIG. 3 is a block diagram showing the functions of a control unit according to the first and second embodiments.

Note that the spectral reflectivity is the ratio (%) of the light intensity for each wavelength reflected by the patch assuming that the reflectivity for each wavelength upon irradiating an ideal white surface (perfect reflecting diffuser) with light is 1. This spectral reflectivity is obtained by, for example, multiplying the ratio, between the light reception intensity obtained by the light-receiving unit 85 upon irradiating a white reference plate opposed to the white LED with light from the white LED and that obtained by the light-receiving unit 85 upon irradiating the patch with light from the white LED, by the spectral reflectivity of the white reference plate. An arithmetic unit 13 shown in FIG. 3 calculates the foregoing spectral reflectivities. Also, the colorimetric value and color information used herein include the above-mentioned light reception intensity output from the color sensor 80, and various types of color values calculated from it. The various types of calculated color values include, for example, the spectral reflectivities described earlier, and tristimulus values X, Y, and Z and L*, a*, and b* to be described later. In other words, a variation in spectral reflectivity corresponds to that in colorimetric value (color information). Also, both the color sensor 80 and a control unit 10 which performs the arithmetic operation of the pieces of detection information obtained by the color sensor 80 correspond to a colorimetry unit which measures the color value (color information). A simple CPU may also be provided in the color sensor 80 to execute various types of arithmetic operations in place of the control unit 10 (to be described later). In this case, the color sensor 80 can solely form a colorimetry unit.

Calculation of the color difference ΔE by the control unit 10 will be described below. From the integrals of the products of a patch spectral reflectivity R(λ) obtained by the color sensor 80, a spectral characteristic P(λ) of a certain light source (ambient light), and color matching functions $\bar{x}$, $\bar{y}$, $\bar{z}$, the tristimulus values X, Y, and Z based on an X-Y-Z color system can be calculated by:

$$X=\int P\cdot R\cdot\bar{x}d\lambda$$

$$Y=\int P\cdot R\cdot\bar{y}d\lambda$$

$$Z=\int P\cdot R\cdot\bar{z}d\lambda \quad (1)$$

Also, L*, a*, and b* can be calculated from X, Y, and Z by:

$$L* = 116\left(\frac{Y}{X}\right)^{1/3} - 16 \quad (2)$$

$$a* = 500\left[\left(\frac{X}{X_n}\right)^{1/3} - \left(\frac{Y}{Y_n}\right)^{1/3}\right]$$

$$b* = 200\left[\left(\frac{Y}{Y_n}\right)^{1/3} - \left(\frac{Z}{Z_n}\right)^{1/3}\right]$$

Moreover, when, for example, a variation from L1*, a1*, and b1* to L2*, a2*, and b2*, respectively, takes place with a variation in profile of the spectral reflectivity, the color difference ΔE between two colors can be calculated in accordance with:

$$\Delta E=\sqrt{((L1^*-L2^*)^2+(a1^*-a2^*)^2+(b1^*-b2^*)^2)} \quad (3)$$

A color control method using the detection result obtained by the color sensor 80 will be described next. The control unit 10 of the image forming apparatus shown in FIG. 3 receives a print image signal containing RGB data which complies with sRGB established by IEC (International Electrotechnical Commission) from, for example, a host PC (not shown). The print image signal received by the control unit 10 is sent to an image processing unit 11 in the control unit 10. The image processing unit 11 analyzes the structure of the print image signal to bitmap the print image signal. The image processing unit 11 also converts the bitmapped print image signal from RGB data into L*a*b* data. Note that RGB, CMY, and L*a*b* color systems use different color representation methods, and can be referred to as, for example, a first color system, a second color system, and a third color system, respectively. The L*a*b* data undergoes color separation using a color conversion lookup table (LUT) 14*a* stored in a conversion table 14. CMYK (Cyan, Magenta, Yellow, and Black) data optimized for the image forming apparatus is generated. The thus generated CMYK data is converted into an output image signal having undergone density variation gray level correction and halftone processing unique to the image forming apparatus, and the obtained signal is sent to the controller 12. The arithmetic unit 13 sets the color conversion LUT 14*a* in color control, based on the detection result obtained by the color sensor 80.

The colorimetric value of the patch T formed on the printing material P varies depending on the temperature. This phenomenon is commonly called thermochromism. The thermochromism can be divided into a variation due to the influence of a fluorescent material (for example, a fluorescent bleaching agent contained in the printing material) and that due to the influence of a nonfluorescent material (toner components). As for the influence of the fluorescent material, the wavelength peak intensity decreases with a rise in temperature. As for the influence of the nonfluorescent material, the profile shifts to the long-wavelength side with a rise in temperature. Also, this phenomenon exhibits different characteristics depending on the color. In this manner, the thermochromism varies the profile of the spectral reflectivity.

Figure 4A:
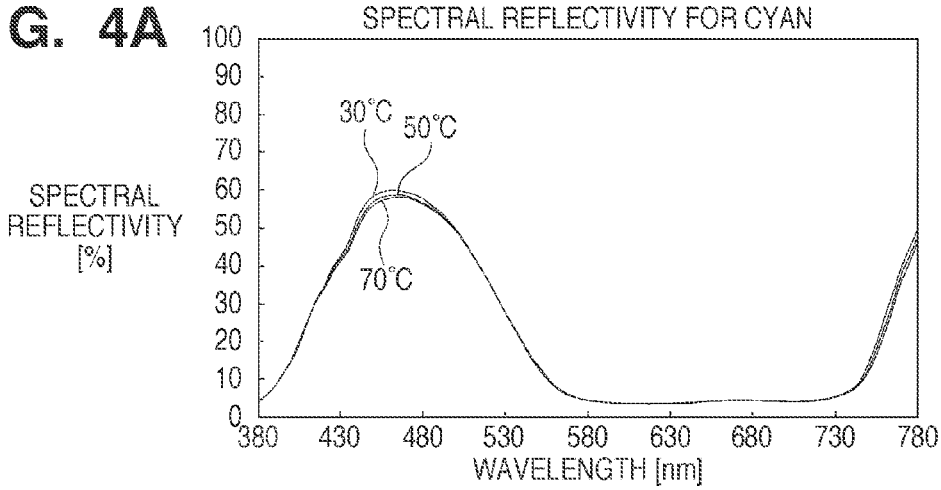
FIGS. 4A, 4B, and 4C are graphs showing variations in spectral reflectively due to thermochromism of a cyan patch, red patch, and green patch, respectively.
Figure 4B:
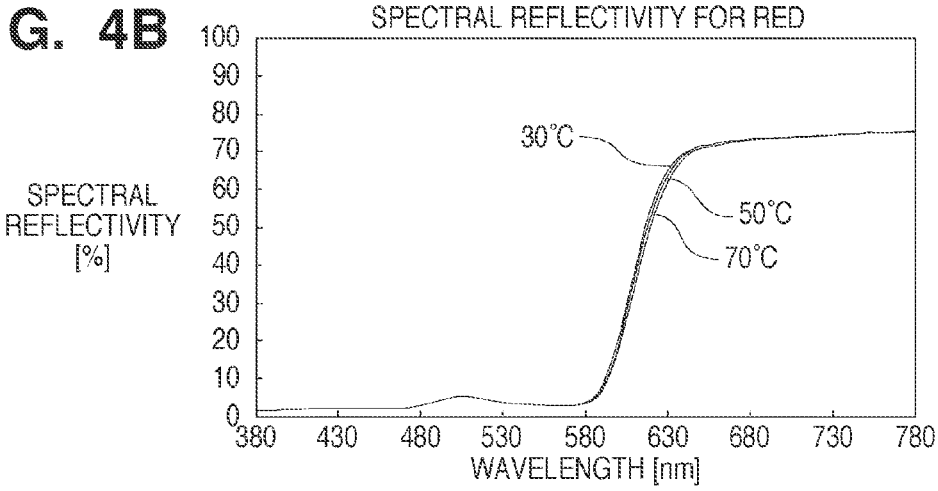
Figure 4C:
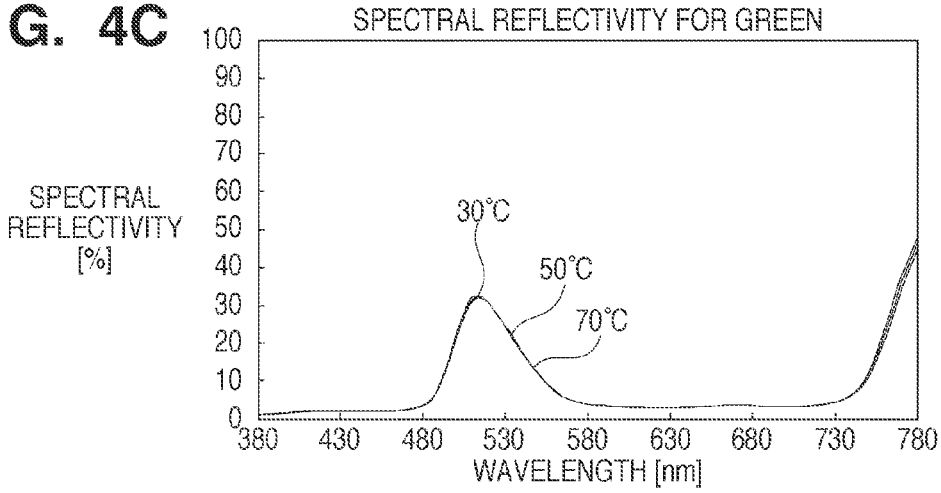

An example of thermochromism examined by changing the temperature in a thermostatic chamber will be given. Color laser copier paper available from Canon Inc. was used as a printing material. With regard to the spectral reflectivity for cyan shown in FIG. 4A, the spectral reflectivity peak varied depending on the temperature due to the influence of a fluorescent material. With regard to the spectral reflectivity for red shown in FIG. 4B, the wavelength range shifted depending on the temperature due to the influence of a nonfluorescent material. With regard to the spectral reflectivity for green shown in FIG. 4C, little variation takes place depending on the temperature. In this manner, a color difference ΔE occurs, as described with reference to equations (1), (2), and (3), when the spectral reflectivity varies in response to a change in temperature.

Figures 5A, 5B:
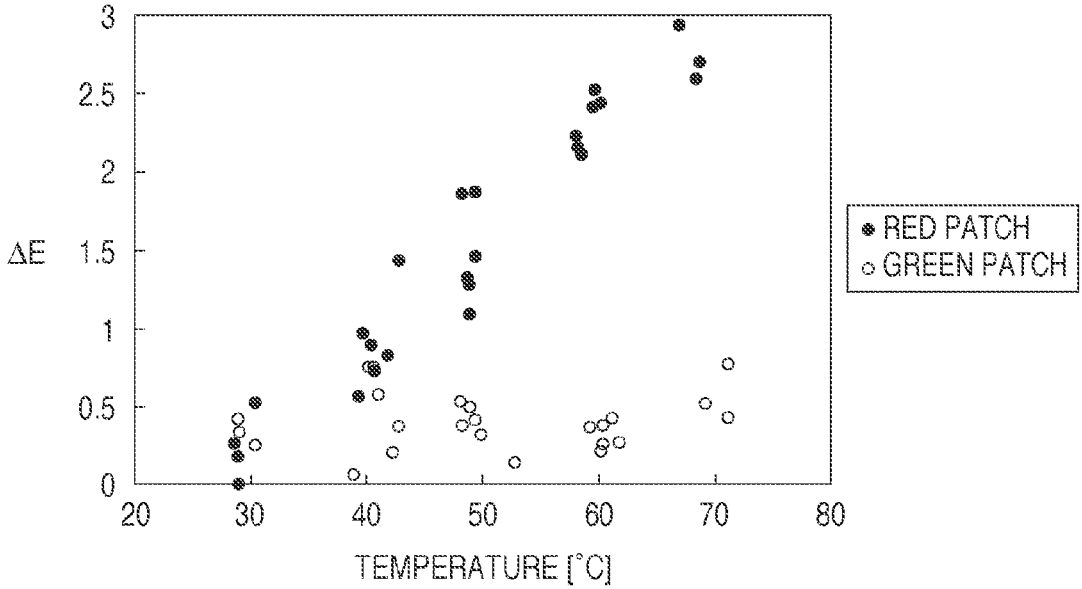
FIG. 5A is a graph showing the color difference due to thermochromism of a representative patch.
FIG. 5B is a table showing the variation $\Delta E/\Delta t$ in the color difference per unit temperature.

FIG. 5A shows the measurement result of the color difference ΔE at the measurement temperature of each of red and green patches. The temperature of each toner patch was raised from 30° C. to 70° C. and was then dropped from 70° C. to 30° C., and this operation was performed three times in succession. The temperature of each toner patch itself was changed in steps of 10° C. without changing the temperature of the colorimetry unit. The red patch, the spectral reflectivity of which greatly varies depending on the temperature, has a large color difference ΔE, while the green patch, the spectral reflectivity of which varies little depending on the temperature, has a small color difference ΔE. Also, the color difference reversibly, nearly linearly varies depending on the temperature. Similar examinations were conducted on magenta, yellow, and blue toner patches, in addition to the red and green patches. FIG. 5B shows the result of calculating the variation ΔE/Δt in color difference ΔE per unit temperature from the color difference when the temperature is 30° C. and 70° C. for each toner patch. The variation ΔE/Δt in color difference per unit temperature reduces in the order of red, magenta, cyan, yellow, blue, and green, as shown in FIG. 5B.

Figure 8:
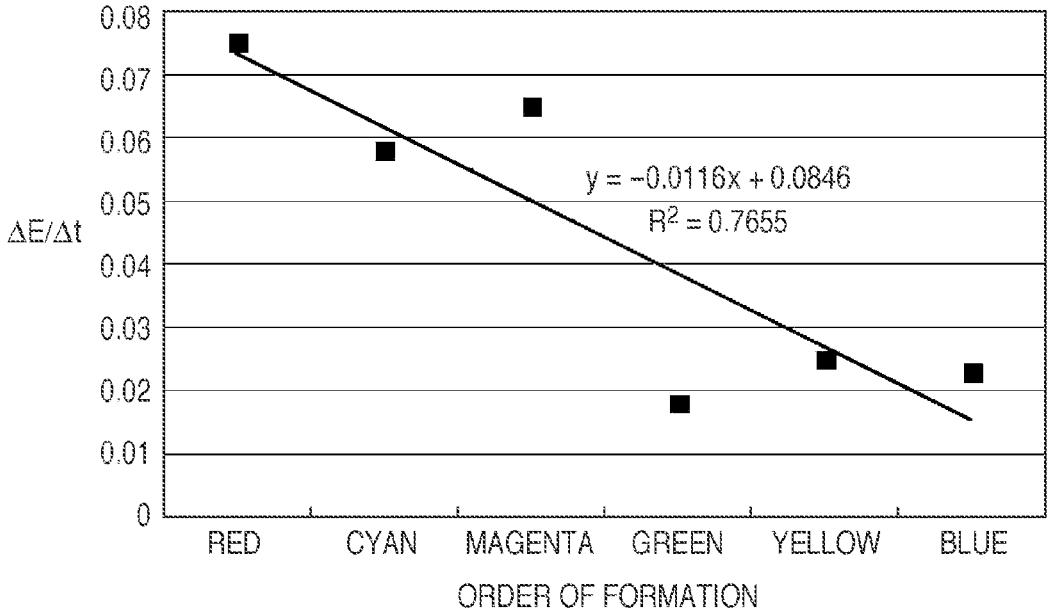
FIG. 8 is a graph showing a variation in $\Delta E/\Delta t$ in the order in which the patches are formed.

An array of patches of a plurality of colors in this embodiment will be described. Assume that the printing material is divided into two regions almost at its center in a direction perpendicular to its conveyance direction. In the following description, the regions on the leading and rear edge sides in the conveyance direction at the time of passage through the fixing unit 61 will be referred to as first and second regions, respectively, hereinafter. In this case, the average of the variations ΔE/Δt, in color difference per unit temperature, of the respective patches is set at least larger in the first region than in the second region. As shown in, for example, FIG. 6A, the respective patches can be arranged in descending order of variation ΔE/Δt in color difference per unit temperature. Also, as shown in FIG. 8, when the variation in ΔE/Δt of each patch in the order of formation on the printing material P is approximated by a linear function, the respective patches can also be arranged such that the linear function has a negative gradient. Referring to FIG. 8, patches are formed in an order of colors different from that shown in FIG. 6A. However, patches are likely to be formed in descending order of ΔE/Δt as a whole, so the color difference ΔE can be kept smaller than when patches are formed in an arbitrary order.

Figure 6A:
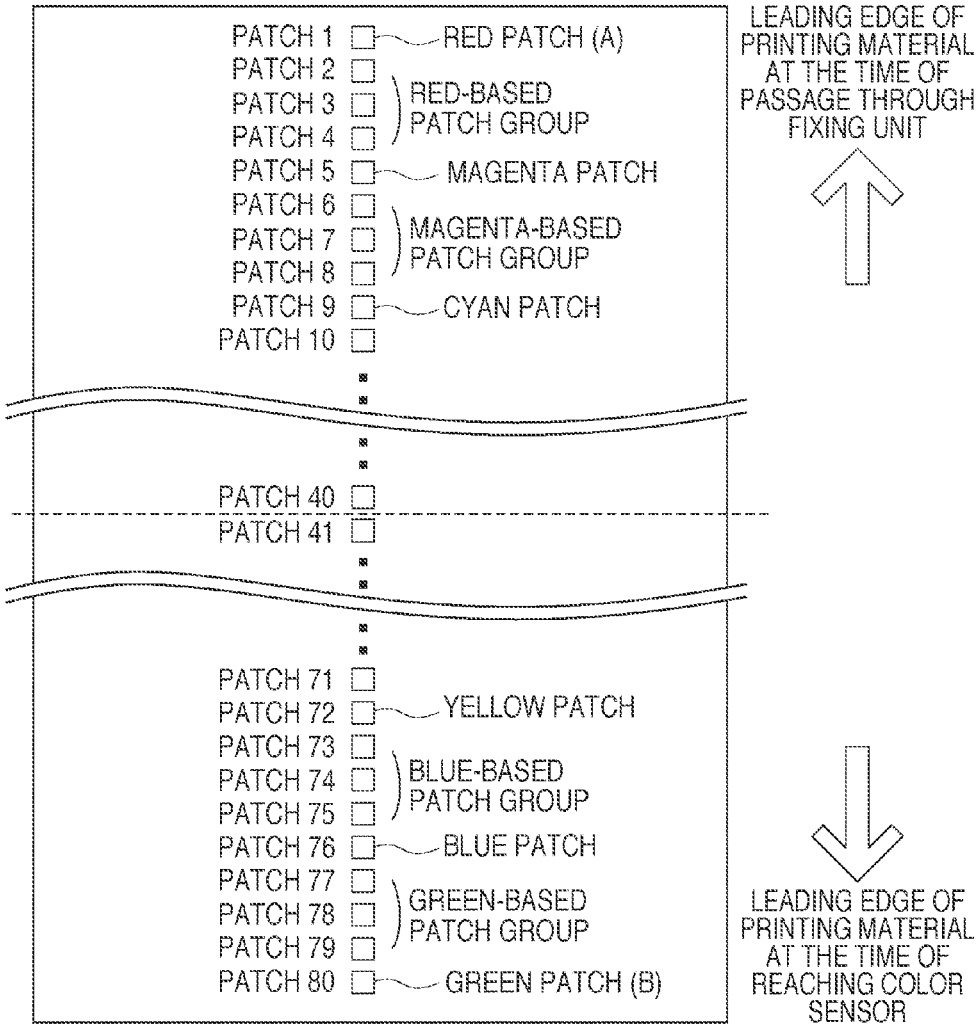
FIG. 6A is a schematic view of an array of patches of a plurality of colors in the first embodiment.

Referring to FIG. 6A, red, magenta, and cyan patches which have large variations in color are placed in the first region on the printing material P. Patches which have colors similar to red and exhibit variations ΔE/Δt almost equal to that of the red patch are defined as a red-based patch group, and are placed next to the red patch. Magenta- and cyan-based patch groups are similarly placed next to the magenta and cyan patches, respectively. On the other hand, green, blue, and yellow patches which have small variations in color are placed in the second region. Patches which have colors similar to green and exhibit variations ΔE/Δt almost equal to that of the green patch are defined as a green-based patch group, and are placed in front of the green patch. Blue- and yellow-based patch groups are similarly placed in front of the blue and yellow patches, respectively.

Figure 6B:
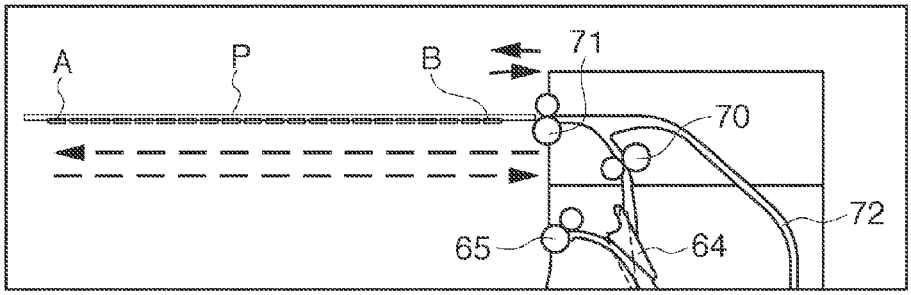
FIG. 6B is a view for explaining conveyance of a printed printing material by a switchback mechanism.

The temperature of each patch in detecting its color value by the color sensor 80 will be described next. FIG. 6B shows the printing material P on which a plurality of patches are printed in the vicinity of a switchback mechanism. Note that a patch present in the first region is defined as a patch A, and a patch present in the second region is defined as a patch B. The moving distance of the patch A is indicated by a broken line, and that of the patch B is indicated by a solid line. The patch B in the second region reaches the measurement position of the color sensor 80 earlier than the patch A in the first region by means of the switchback mechanism. Because the respective patches move by different distances to reach the measurement position of the color sensor 80, they require different times to reach the color sensor 80 upon passing through the reversing roller pair 71.

Figure 7A:
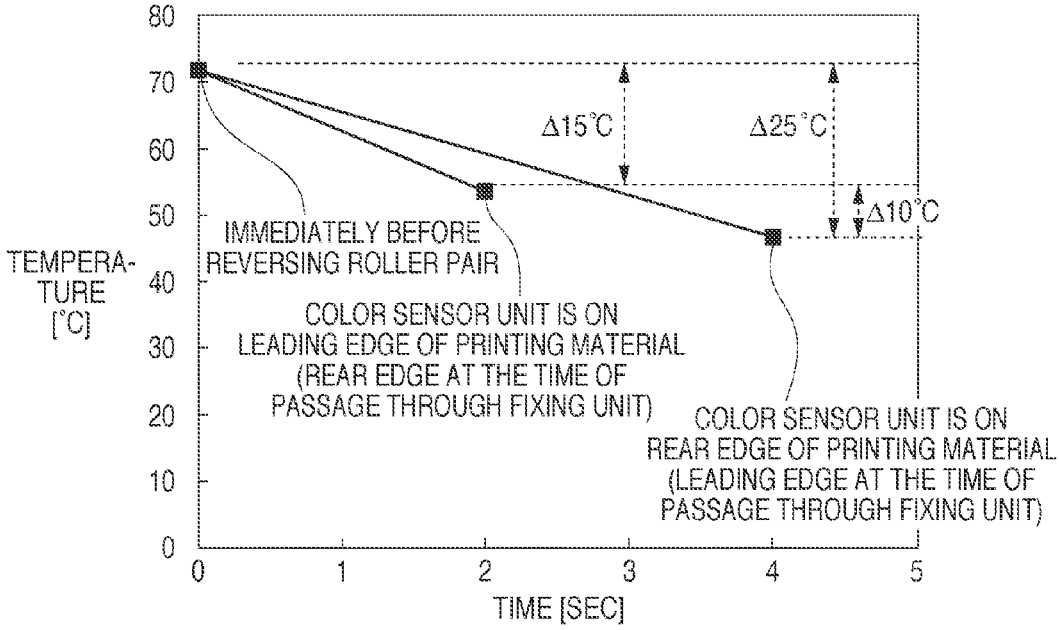
FIG. 7A is a graph showing a change in temperature of the patch on the printing material.

FIG. 7A shows the measurement result of a change in temperature of each patch. The temperatures of patches A and B immediately before the reversing roller pair 71, and those of patches A and B at the measurement position of the color sensor 80 were measured. The time at which both the patches A and B on the printing material P have reached the position immediately before the reversing roller pair 71 is used as the origin. Also, A3-size paper is loaded in the portrait orientation as the printing material for measurement. The conveyance velocity of the printing material P stays nearly constant, so the time plotted on the abscissa of a graph shown in FIG. 7A also corresponds to the moving distance of the printing material P in the image forming apparatus. Referring to FIG. 7A, the temperature of each patch immediately before the reversing roller pair 71 was 70° C. In contrast to this, the temperature of the patch B at the position of the color sensor 80 was 55° C., and that of the patch A was 45° C. The difference in temperature between the patches B and A at the measurement position of the color sensor 80 was 10° C. Because the patches A and B require different times to reach the measurement position of the color sensor 80 upon passing through the fixing unit 61, they naturally have different temperatures in colorimetry by the color sensor 80.

Figure 7B:
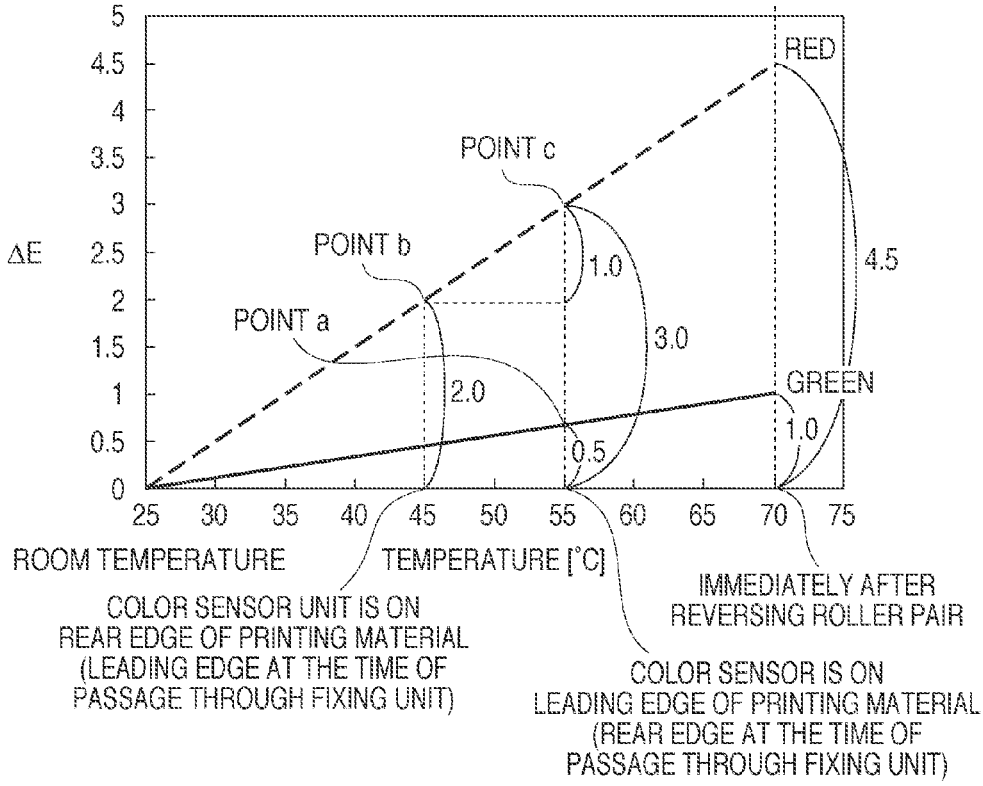
FIG. 7B is a graph showing the color difference due to a change in temperature of the patch.

The examination result in this embodiment will be described next. FIG. 7B shows the relationship between the temperature and the color difference ΔE assuming 25° C. as a reference, and a solid line indicates the green patch and a broken line indicates the red patch. As shown in FIG. 6A, upon placing the green patch in the second region, the time taken for the green patch to move from the fixing unit 61 to the color sensor 80 shortens. However, the green patch is less likely to be influenced by a variation in color value due to thermochromism than the red patch. As indicated by a point a, the color difference ΔE of the green patch when the temperature is room temperature and that at the position of the color sensor 80 is 0.5. On the other hand, as shown in FIG. 6A, the red patch is placed in the first region, and the time taken for the red patch to move from the fixing unit 61 to the color sensor 80 is set relatively long to reduce the difference between room temperature and the temperature of the position of the color sensor 80. Thus, as indicated by a point b, the color difference ΔE of the red patch when the temperature is room temperature and that at the position of the color sensor 80 can be set to 2.0.

For example, a patch array obtained by reversing that shown in FIG. 6A will be considered. In this case, green, blue, and yellow patches, which have small variations in color, are placed in the first region, and red, magenta, and cyan patches which have large variations in color are placed in the second region. In this case again, as indicated by a point c in FIG. 7B, the color difference ΔE of the red patch when the temperature is room temperature and that at the position of the color sensor 80 becomes 3.0. In this embodiment, as described above, the color difference ΔE of the red patch is 2.0, and this means that the color difference ΔE in this embodiment can be kept smaller by 1.0 than that when the patch array shown in FIG. 6A is reversed.

Although a spectroscopic sensor is used as the color sensor 80 in this embodiment, the present invention is not limited to a spectroscopic sensor. A color sensor of another scheme such as the RGB scheme may be used as long as it can measure the color difference ΔE due to thermochromism.

As has been described above, in the image forming apparatus including the color sensor 80 in a double-sided printing mechanism equipped with a switchback mechanism, a variation in color due to thermochromism can be suppressed while suppressing deterioration in usability using the patch array presented in this embodiment. This makes it possible to improve the tonal accuracy.

Second Embodiment

An image forming apparatus according to the second embodiment will be described below. The basic configuration in the second embodiment is the same as in the first embodiment, and a description of the same parts will not be given. A feature of this embodiment lies in changing the patch array in accordance with the type of printing material. Some printing materials contain fluorescent components in large amounts while others contain less fluorescent components. The temperature dependence of the spectral reflectivity differs between a printing material containing a fluorescent component in large amounts and that containing less fluorescent component. The temperature dependence of the spectral reflectivity means herein the degree of variation in color information (information on ΔE), that occurs in response to a change in temperature (for example, a rise in temperature) by a predetermined amount, and the larger the variation, the higher the temperature dependence.

Figure 9A:
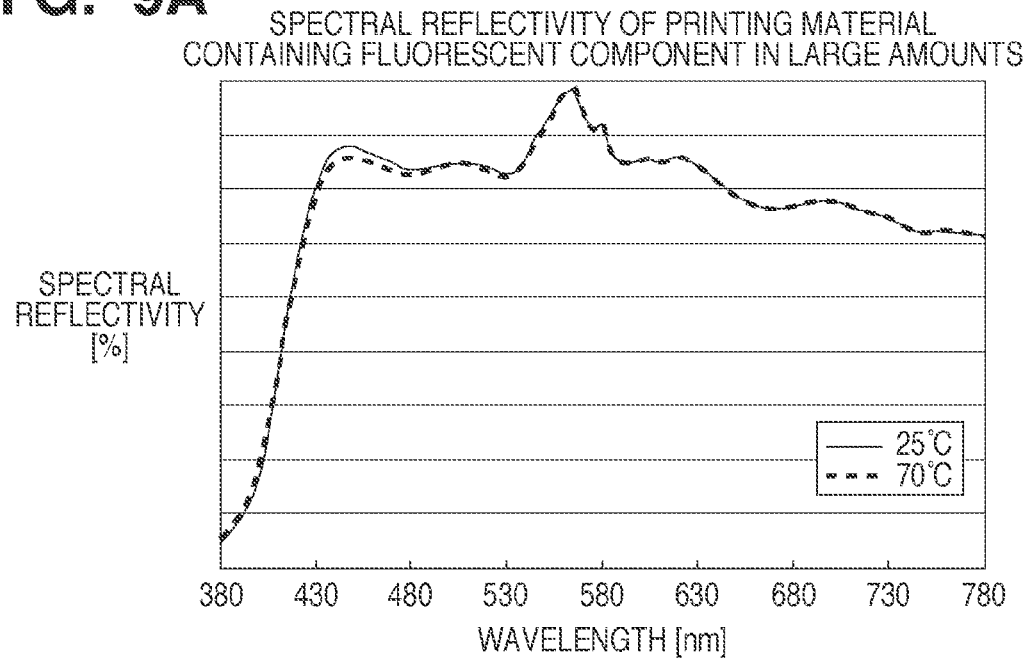
FIGS. 9A and 9B are graphs showing the spectral reflectivity of a printing material containing a fluorescent component and that of a printing material containing no fluorescent component, respectively.
Figure 9B:
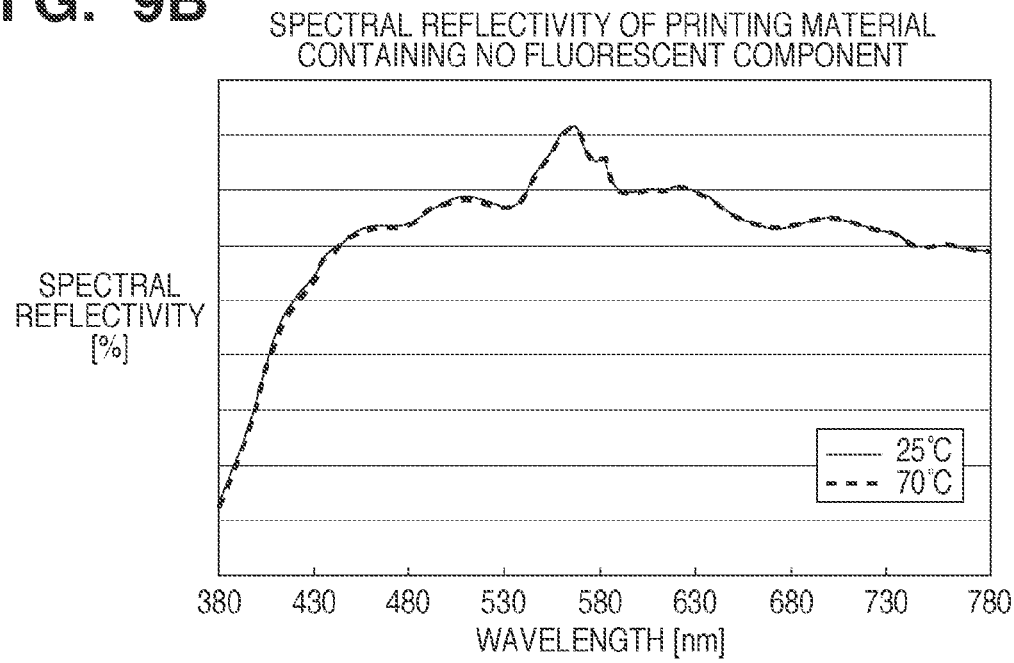
Figure 10:
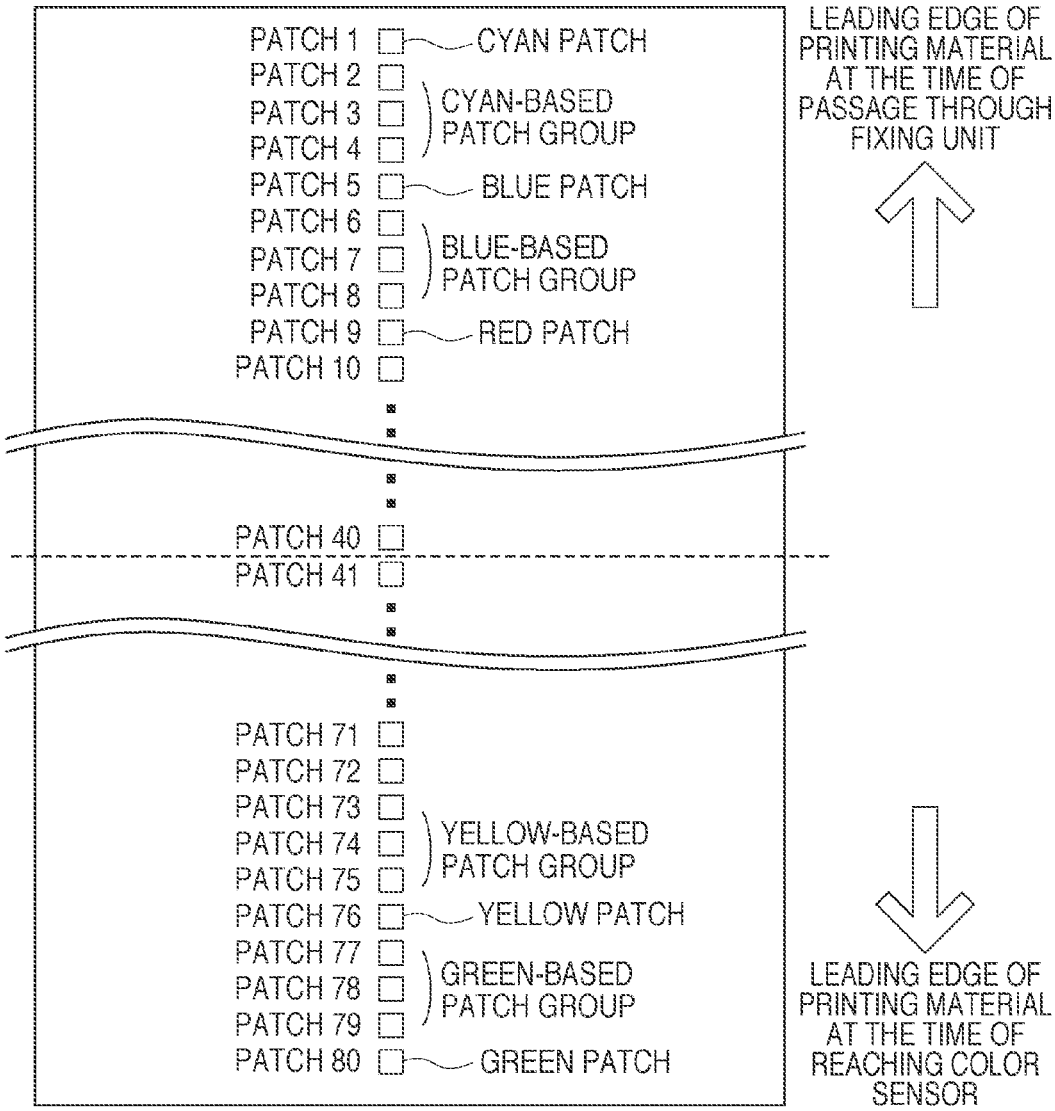
FIG. 10 is a schematic view of a patch array in the second embodiment.

FIG. 9A shows the temperature dependence of the spectral reflectivity of a printing material (Hammermill Paper available from International Paper) containing a fluorescent component in large amounts, and FIG. 9B shows the temperature dependence of the spectral reflectivity of a printing material (Tokubishi available from Mitsubishi Paper Mills Limited) containing less fluorescent component. A solid line indicates the spectral reflectivity at 25° C., and a broken line indicates the spectral reflectivity at 70° C. The printing material containing a fluorescent component in large amounts has a peak value which varies depending on the temperature on the short-wavelength side, as shown in FIG. 9A. On the other hand, the printing material containing less fluorescent component has a spectral reflectivity which does not vary depending on the temperature, as shown in FIG. 9B. That is, the error of color information obtained by colorimetry differs depending on whether the printing material used contains a fluorescent component in large amounts. In view of this, in this embodiment, the type of patch array is changed between that which is for a printing material containing a fluorescent component in large amounts and the other which is for a printing material containing no or less fluorescent component, in accordance with an instruction from a control unit 10. This makes it possible to suppress a variation in color due to thermochromism in accordance with the type of printing material. A change in patch array will be described in detail next. First, a patch array corresponding to a printing material containing no or less fluorescent component is the same as that shown in FIG. 6A. On the other hand, as for a printing material containing a fluorescent component in large amounts, cyan and blue patches which are more likely to be influenced by a fluorescent component are placed in the first region, as shown in FIG. 10.

Note that as in the first embodiment, a patch group of colors similar to that of each patch is placed next to this patch in the first region. Also, a patch group of colors similar to that of each patch is placed in front of this patch in the second region. Again as in the first embodiment, the average of the variations $\Delta E/\Delta t$ of the respective patches is larger in the first region than in the second region. Again as in the first embodiment, when the variation in $\Delta E/\Delta t$ of each patch in the order of formation is approximated by a linear function, the linear function has a negative gradient.

Various kinds of methods are known to determine the presence/absence (amount) of a fluorescent component in the printing material directly by the image forming apparatus. For example, the user can designate information concerning the presence/absence (amount) of a fluorescent component via an image forming apparatus operation panel or a user interface of a host PC in printing, and the control unit 10 can identify this information. Alternatively, information concerning the presence/absence (amount) of a fluorescent component may be added to a print image signal, and the control unit 10 may identify this information. Or again, a sensor capable of detecting a fluorescent component may be attached to the image forming apparatus to automatically switch the patch array to an appropriate one. An identifier indicating the product number of a printing material may be embedded in this printing material, and a table which associates the product number identifier and the information on the presence/absence of a fluorescent component with each other may be provided in the image forming apparatus to discriminate the embedded identifier by a sensor, thereby determining the presence/absence of a fluorescent component.

In this embodiment, with the above-mentioned configuration, the error of a colorimetric value due to the difference in type of printing material can be reduced. Despite a variation in characteristic of the printing material, the colorimetric error of a patch in a color with a large average of $\Delta E/\Delta t$ can be reduced, as has been described in the first embodiment, in accordance with a variation in type of printing material.

Third Embodiment

Figure 11A:
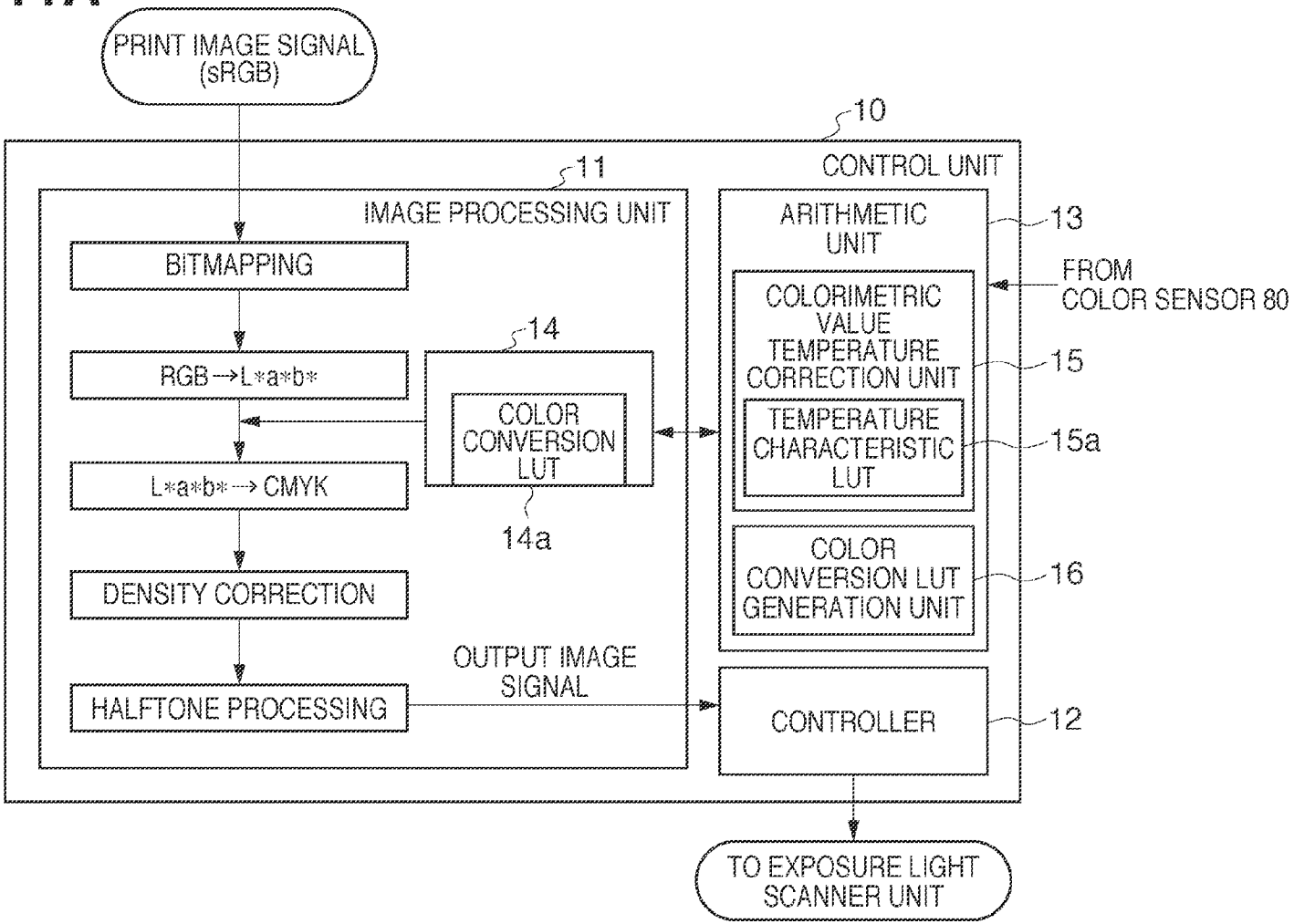
FIG. 11A is a block diagram showing the functions of a control unit according to the third embodiment.
Figures 11B, 11C:
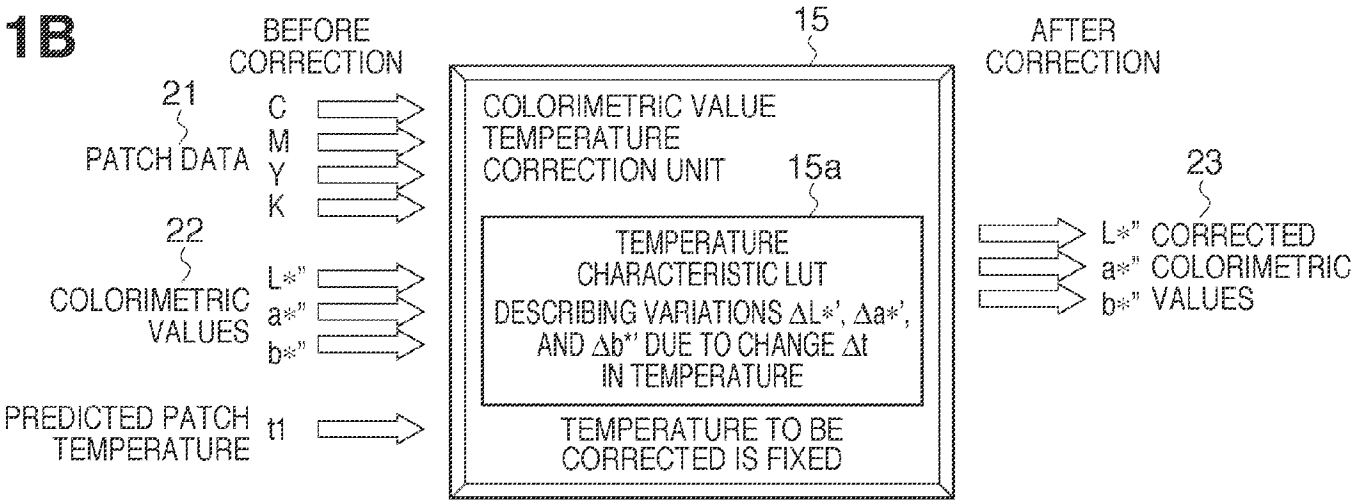
FIG. 11B is a block diagram of a colorimetric value temperature correction unit.
FIG. 11C shows a temperature characteristic look-up table.

An image forming apparatus according to the third embodiment will be described below. FIG. 11A is a functional block diagram of a control unit 10 in the image forming apparatus shown in FIG. 1, according to this embodiment. In this embodiment, a colorimetric value temperature correction unit 15 is added to the configuration according to the first and second embodiments. Thus, color information obtained by colorimetry is corrected in accordance with the temperature of a color patch in the colorimetry. Based on the thus corrected color information, a color conversion LUT generation unit 16 of an arithmetic unit 13 updates a color conversion LUT 14*a*. Note that the image forming process in this embodiment is the same as in the first embodiment, and a description thereof will not be given. In this embodiment, the arithmetic unit 13 obtains a correction coefficient by looking up a temperature characteristic LUT 15*a* of the colorimetric value temperature correction unit 15, in accordance with patch data. The arithmetic unit 13 corrects the patch colorimetric value based on the obtained correction coefficient. The patch data means herein data indicating the ratio at which the densities of C, M, Y, and K are combined to generate a patch. The control unit 10 analyzes this data. Referring to FIG. 11C, 100% density is defined as 1, and a red patch, for example, is generated using 0% cyan, 100% magenta and yellow, and 0% black.

FIG. 11B is a view showing the configuration of the colorimetric value temperature correction unit 15. Variations $\Delta L^{*\prime}$, $\Delta a^{*\prime}$, and $\Delta b^{*\prime}$ per unit temperature are decided from patch data 21 and the temperature characteristic LUT 15*a* prepared in advance. From a predicted patch temperature t1, a desired target temperature t2, and patch colorimetric values 22 ($L^*$, $a^*$, $b^*$) obtained as a result of measurement by a color sensor 80, colorimetric values 23 ($L^{*\prime\prime}$, $a^{*\prime\prime}$, $b^{*\prime\prime}$) at the desired target temperature t2 are calculated in accordance with:

$$L^{*\prime\prime}=L.+(t2-t1)\Delta L.' \tag{4}$$

$$a.''=a.+(t2-t1)\Delta a.' \tag{5}$$

$$b.''=b.+(t2-t1)\Delta b.' \tag{6}$$

The temperature characteristic LUT 15*a* in this embodiment stores the temperature variation characteristic of color information for each patch data (C, M, Y, and K density values) printed on a printing material as a target in advance. FIG. 11C illustrates an example of the temperature characteristic LUT 15*a*. In this embodiment, a table obtained by linearly approximating variations in L., a., and b. due to a change in temperature, and recording the variations $\Delta L.$, $\Delta a.'$, and $\Delta b.'$ in color value per unit temperature for each patch data, is used as the temperature characteristic LUT 15*a*. The variations $\Delta L.'$, $\Delta a.'$, and $\Delta b.'$ serve as correction coefficients (arithmetic coefficients), as described with reference to equations (4) to (6). The temperature characteristic LUT 15*a* as described above is held in the colorimetric value temperature correction unit 15. Although FIG. 11C shows only 100% and 0% as an example, halftone patch data may be stored and the values $\Delta L.'$, $\Delta a.'$, and $\Delta b.'$ corresponding to this data may be held in the table.

Figure 12:
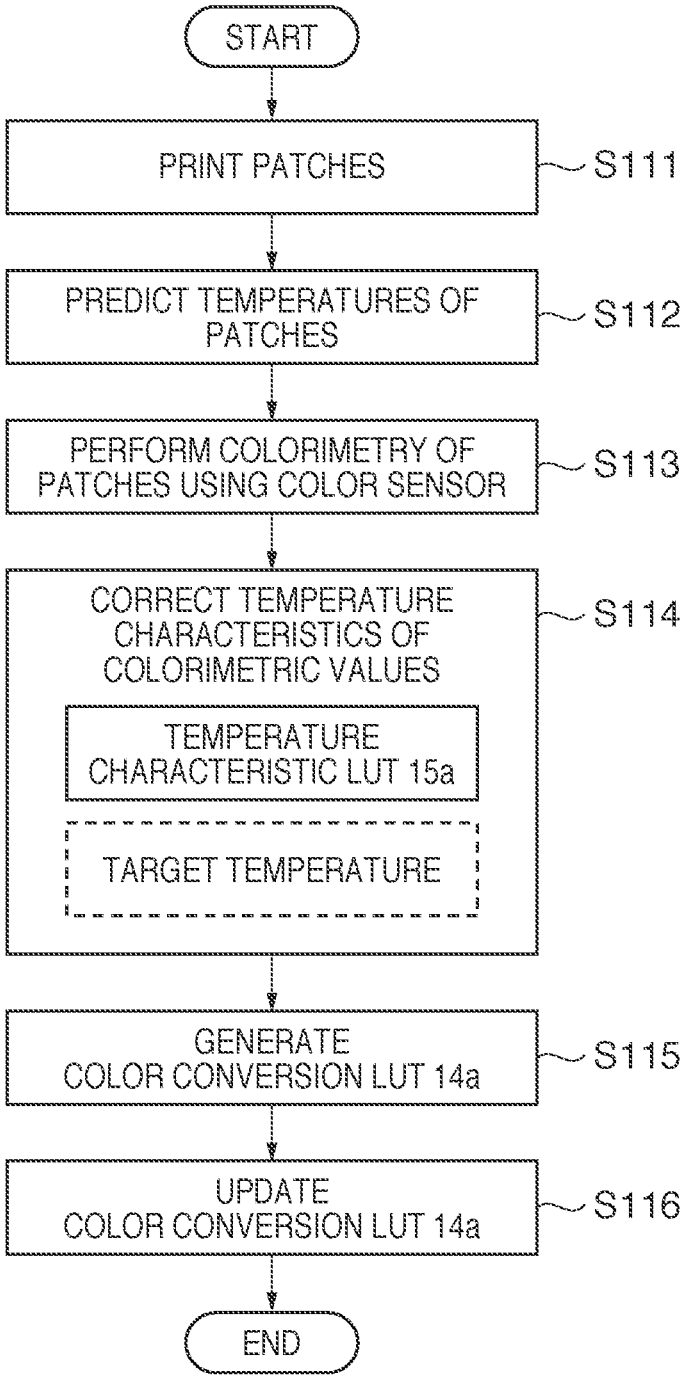
FIG. 12 is a flowchart showing colorimetric value correction in the third embodiment.

A color control method in this embodiment will be described. The sequence of colorimetric value correction in the image forming apparatus according to this embodiment will be described with reference to FIG. 12. In step S111, patches are printed on the printing material P by the image forming process, described with reference to FIG. 1, based on an instruction from the control unit 10 of the image forming apparatus. In step S112, the control unit 10 predicts the temperatures of the patches switched back by the reversing roller pair 71. As a prediction method, those temperatures are predicted based on, for example, the time elapsed after patches are formed on the printing material P. In step S113, the control unit 10 uses the color sensor 80 to perform colorimetry of the patches having their temperatures predicted in step S112. In step S114, the colorimetric value temperature correction unit 15 of the control unit 10 corrects the patch colorimetric values based on the predicted temperatures and correction coefficients (arithmetic coefficients) obtained by looking up the temperature characteristic LUT 15*a* from patch data. In step S115, the color conversion LUT generation unit 16 of the control unit 10 generates color conversion information. In step S116, the arithmetic unit 13 updates the color conversion LUT 14*a* based on the generated color conversion information.

With the above-mentioned sequence of colorimetric value correction, the colorimetric values can be corrected. Note that the patch array pattern according to which patches are formed on the printing material P is the same as in the first and second embodiments, and a detailed description thereof will not be given.

An effect of colorimetric value correction using temperature prediction in this embodiment will be described.

Figure 13:
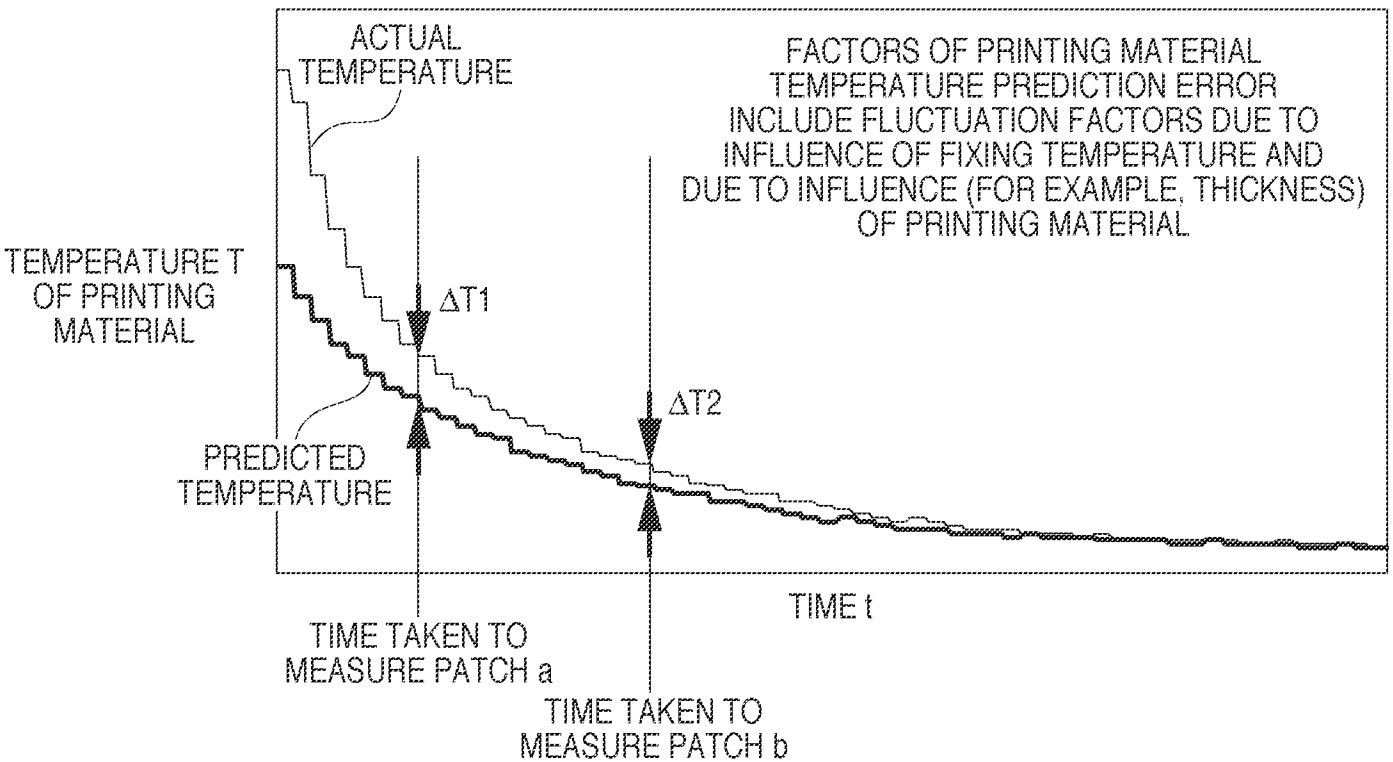
FIG. 13 is a graph for explaining an error of the predicted temperature in the third embodiment.

FIG. 13 is a graph showing a temporal change in error between the predicted temperature and the actual temperature. Examples of the causes for the error between the predicted temperature and the actual temperature include fluctuations due to the influence of the fixing temperature and the influence (for example, the thickness) of the printing material. This error exponentially decreases with time, and gets closer to zero as the temperature approximates room temperature. In the image forming apparatus including the switchback mechanism, a relatively short time elapses from fixing of a patch a in the second region until its colorimetry while a relatively long time elapses from fixing of a patch b in the first region until its colorimetry, as shown in FIG. 13. Therefore, the error of the patch a between the predicted temperature and the actual temperature remains still large while that of the patch b between the predicted temperature and the actual temperature becomes relatively small.

Figure 14A:
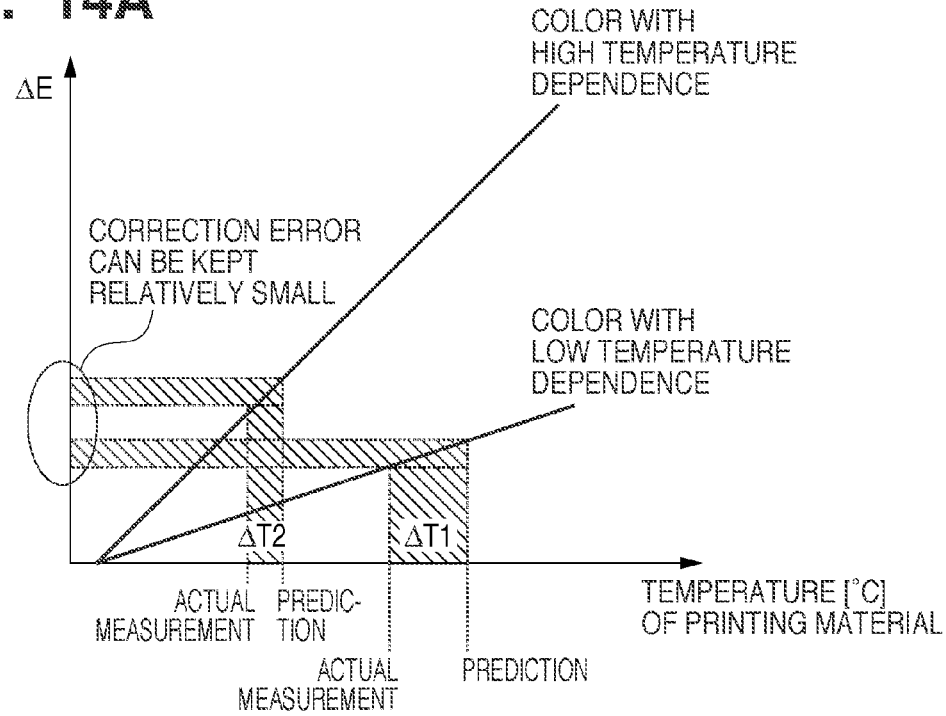
FIGS. 14A and 14B are graphs showing the influences of errors of the predicted temperatures in the third embodiment and the prior art, respectively.
Figure 14B:
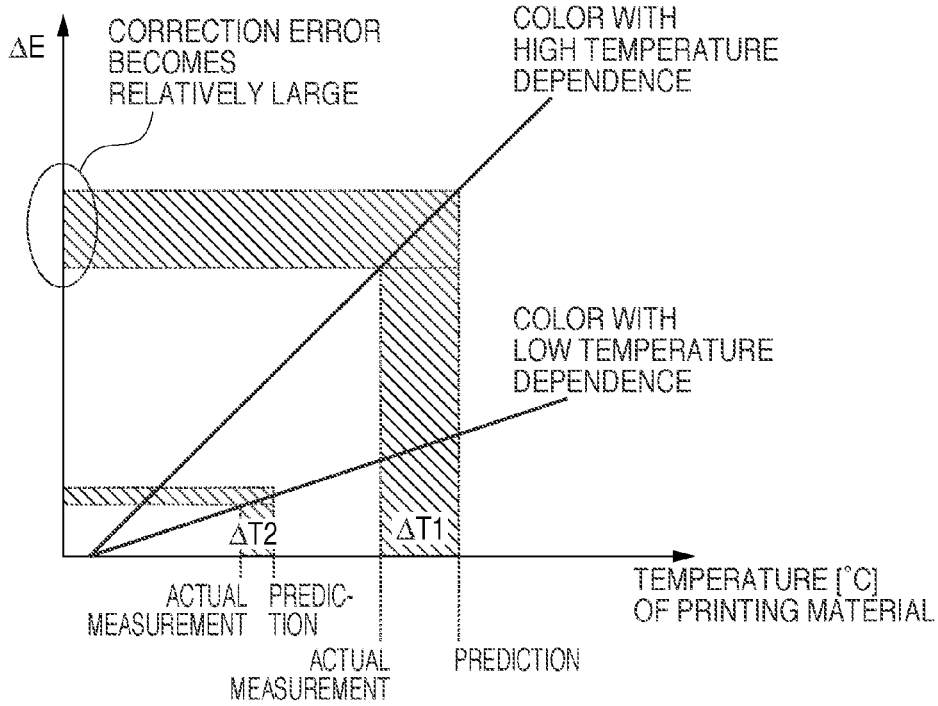

FIGS. 14A and 14B show the influence that the temperature prediction error exerts on a color difference ΔE. FIG. 14A shows a case in which the patch array in this embodiment shown in FIG. 6A or 10 is used. Also, FIG. 14B shows a case in which the patch array shown in FIG. 6A or 10 is reversed. As shown in FIG. 14A, in this embodiment, a color with a high temperature dependence is placed in the first region, so the error between the predicted temperature and the actual temperature becomes relatively small, thus making it possible to suppress the influence that this error exerts on the color difference ΔE. Also, even when a color with a low temperature dependence is placed in the second region, the error between the predicted temperature and the actual temperature for this color exerts little influence on the color difference ΔE. On the other hand, as shown in FIG. 14B, in the reversed patch array, a color with a high temperature dependence is placed in the second region, so the error between the predicted temperature and the actual temperature becomes relatively large and therefore has a considerable influence on the color difference ΔE. Also, even when a color with a low temperature dependence is placed in the first region, no effect of suppressing the influence that the error exerts on the color difference ΔE cannot be obtained.

As has been described above, in this embodiment, the color conversion LUT 14*a* is set and rewritten based on colorimetric data, and image data is output in accordance with the changed color conversion LUT 14*a*, thereby making it possible to reduce the color difference ΔE from a reference color. That is, in the image forming apparatus including the color sensor 80 in a double-sided printing mechanism equipped with a switchback mechanism, the influence of a variation in color value due to thermochromism can be suppressed using the patch array presented in this embodiment. More specifically, the values (t2−t1)ΔL.', (t2−t1)Δa.', and (t2−t1)Δb.' in equations (4) to (6), respectively, can be reduced as a whole, thus suppressing deterioration in colorimetric value correction accuracy. This makes it possible to improve the accuracy of control which uses a color conversion LUT.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-049865 filed on Mar. 5, 2010, which is hereby incorporated by reference herein in its entirety.

What is claimed is:

1. An image forming apparatus including a fixing unit configured to heat and fix a toner image transferred onto a printing material, comprising:

a switchback mechanism configured to reverse a conveyance direction of a printing material on which the toner image is fixed; and a colorimetry unit which is located in a vicinity of a conveyance path conveying the printing material, the conveyance direction of which is reversed by the switchback mechanism, and is configured to obtain pieces of color information of patches of a plurality of colors, formed on the printing material, from light reflected by the patches of the plurality of colors upon irradiating the patches of the plurality of colors with light, wherein an average of a variation in the color information of a patch, formed in a first region on the printing material, in response to a predetermined change in temperature is larger than an average of a variation in the color information of a patch, formed in a second region on the printing material, in response to the predetermined change in temperature, and the first region and the second region are on a leading edge side and a rear edge side, respectively, at a time of passage through the fixing unit when the printing material is divided into two regions in a direction perpendicular to the conveyance direction.

2. The apparatus according to claim 1, wherein the patches are formed on the printing material in descending order of variation in the color information in response to the change in temperature.

3. The apparatus according to claim 1, wherein the variation in the color information corresponds to a variation in spectral reflectivity, and the variation in spectral reflectivity includes a variation in peak intensity and a shift in wavelength range.

4. The apparatus according to claim 1, wherein an array of the patches is changed in accordance with a type of the printing material.

5. The apparatus according to claim 4, further comprising an arithmetic unit configured to predict a temperature of each patch in colorimetry by the colorimetry unit, and correct the color information obtained by the colorimetry unit based on the predicted temperature.

6. The apparatus according to claim 1, further comprising an image processing unit configured to convert input image data from a first color system into a second color system based on the pieces of color information obtained by said colorimetry unit.

7. An image forming apparatus including a fixing unit configured to heat and fix a toner image transferred onto a printing material, comprising:

a switchback mechanism configured to reverse a conveyance direction of a printing material on which the toner image is fixed; and a colorimetry unit which is located in a vicinity of a conveyance path conveying the printing material, the conveyance direction of which is reversed by the switchback mechanism, and is configured to obtain pieces of color information of patches of a plurality of colors, formed on the printing material, from light reflected by the patches of the plurality of colors upon irradiating the patches of the plurality of colors with light, wherein when a variation in the color information of each patch, formed on the printing material, in response to a predetermined change in temperature is approximated by a linear function in an order of formation of the patches, the linear function has a negative gradient.

* * * * *